US006032649A

United States Patent [19]

Ono

[11] Patent Number: 6,032,649

[45] Date of Patent: Mar. 7, 2000

[54] ENGINE CONTROL SYSTEM

[75] Inventor: Masato Ono, Tochiqi, Japan

[73] Assignee: Keihin Corporation, Tokyo, Japan

[21] Appl. No.: 09/108,321

[22] Filed: Jul. 1, 1998

[30] Foreign Application Priority Data

Oct. 27, 1997 [JP] Japan ..... 9-293995

[51] Int. Cl.[7] ..... F02P 5/00

[52] U.S. Cl. ..... 123/406.58; 123/617; 123/609

[58] Field of Search ..... 123/406.58, 617, 123/609

[56] References Cited

U.S. PATENT DOCUMENTS

| | | | |
|---|---|---|---|
| 4,870,587 | 9/1989 | Kumagai | 123/617 |
| 4,915,086 | 4/1990 | Ciliberto et al. | 123/609 |
| 4,972,818 | 11/1990 | Nomura et al. | 123/609 |
| 5,054,461 | 10/1991 | Deutsch et al. | 123/609 |
| 5,251,600 | 10/1993 | Britsch et al. | 123/406.58 |
| 5,429,093 | 7/1995 | Fukui et al. | 123/406.58 |
| 5,647,322 | 7/1997 | Fukui et al. | 123/406.58 |
| 5,823,166 | 10/1998 | Entenmann et al. | 123/406.58 |

*Primary Examiner*—John Kwon

*Attorney, Agent, or Firm*—Nikaido, Marmelstein, Murray & Oram LLP

[57] ABSTRACT

An engine control system in which a rotary body rotates in association with a crankshaft of an engine and has portions to be detected every predetermined angle and at least one of the portions to be detected is missing, and a pickup is arranged near an outer periphery of the rotary body and generates a pulse each time the portion to be detected passes. In the case where a reference time point to start a measurement of a time until a control start time point to start a predetermined control of the engine is a rotational angle time point of the crankshaft when no pulse is generated from the pickup due to a missing portion to be detected, a timer is allowed to measure the time from a generation time point of the pulse generated from the pickup just before the non-pulse generation period of time during which no pulse is generated until the control start time point.

4 Claims, 12 Drawing Sheets

720°
360°
180°
90°
#1,4TDC
#2,3TDC
#1,4TDC
#2,3TDC
NE1
FISTG
STAGL
NE2
0 1 2 3 4 5 6 7 8 9 0 1 2 3 4 5 6 7 8 9 0 1 2 3 4 5 6 7 8 9

ENGINE CONTROL SYSTEM

BACKGROUND OF THE INVENTION

1. Field of the Invention

The present invention relates to an engine control system for controlling a current supply to an ignition coil and a fuel injection of an engine.

2. Description of the Related Background Art

In an engine control system, when a timing to supply a current to an ignition coil or an ignition timing for allowing a spark plug to discharge a spark, a rotational angle position from a reference position of a crankshaft of an engine, that is, a crank angle is detected and those timings are set on the basis of the crank angle (for example, JP-A-63-263269 and JP-B-5-11562).

In order to detect an angle of a crankshaft of an engine, a disk-shaped rotary body which rotates in response to the rotation of the crankshaft and an electromagnetic pickup arranged near the outer periphery of the rotary body are used. A plurality of convex portions made of a magnetic material are provided as portions to be detected every predetermined angle on or near the outer periphery of the rotary body and at least one of the convex portions is missing. When the rotary body rotates in association with the crankshaft and the convex portion passes near the electromagnetic pickup, a pulse is generated from the electromagnetic pickup. A relatively long period in which no pulse is generated due to the missing of the convex portion occurs. By measuring such a period, it is assumed that a time point of a pulse to be generated next shows a reference position time point of a rotational angle of the crankshaft, and a stroke of each cylinder is specified on the basis of a reference position time point.

A time from the reference position time point of the crankshaft until an engine control start time point in response to the pulse generated from the pickup at an angle position of every predetermined angle, for example, until a time point when the current supply is started, or a time until a time point to stop the current supply and allow the spark plug to discharge a spark, and further a time until a start time point of a fuel injection are measured.

In a conventional engine control system, however, since there is a period of time in which no pulse is generated from the pickup due to a missing of the portion to be detected such as a convex portion of the rotary body even when the angle position of the crankshaft is at the angle position of every predetermined angle from the reference position time point, if there is an engine control in which the start time point of time measurement should be set at an angle position time point of the crankshaft in such a period, the measurement of time until the engine control start time point cannot be started. The engine control start time point is, therefore, set earlier and there is a problem such that a proper engine control cannot be performed.

SUMMARY OF THE INVENTION

It is, therefore, an object of the invention to provide an engine control system which can perform a proper engine control even when there is a predetermined engine control in which any one of rotational angle time points of every predetermined angle of a crankshaft is used as a measurement start time point of time until a control start time point.

According to the invention, there is provided an engine control system comprising: a rotary body which rotates in association with a crankshaft of an engine and has portions to be detected every predetermined angle and in which at least one of the portions to be detected is missing; a first pickup which is arranged near an outer periphery of the rotary body and generates a pulse each time the portion to be detected passes; setting means for setting a time until a control start time point to start a predetermined control of the engine by using any one of rotational angle time points of every predetermined angle of the crankshaft as a reference; and timer control means for allowing a timer to measure a time until the control start time point by using a generation time point of a pulse generated from the first pickup as a reference, characterized in that when a time until the control start time point in which the rotational angle time point of the crankshaft when no pulse is generated from the first pickup due to a missing portion to be detected is used as a reference is set by the setting means, the timer control means allows the timer to measure a time from a generation time point of a pulse generated from the first pickup just before a no-pulse generation period of time in which no pulse is generated to the control start time point.

DETAILED DESCRIPTION OF THE PREFERRED EMBODIMENTS

Embodiments of the present invention will be described in detail hereinbelow with reference to the drawings.

Figure 1:
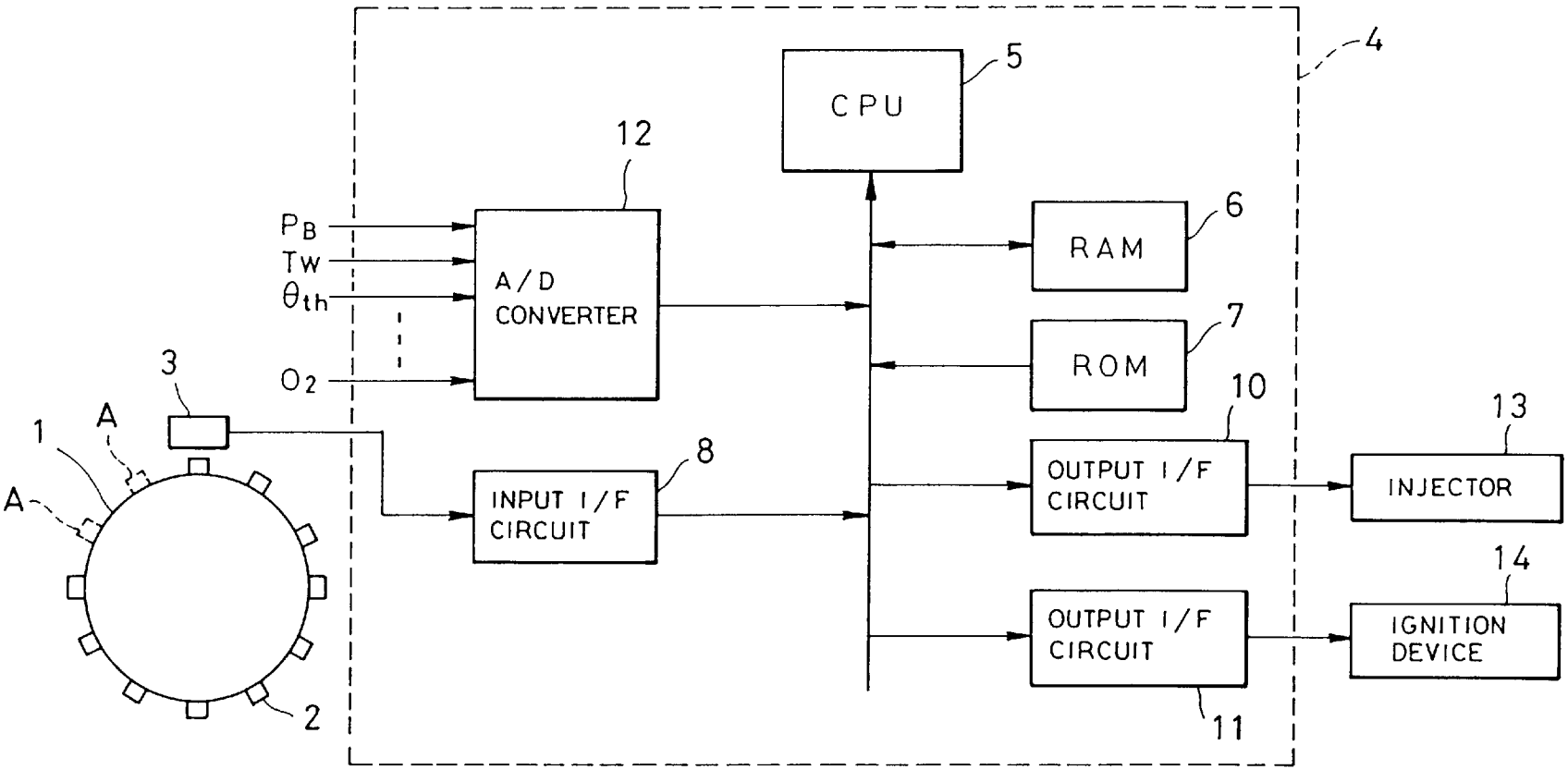
FIG. 1 is a block diagram showing an embodiment of the invention.

FIG. 1 shows an engine control system according to the present invention. The engine control system has a disk-shaped rotary body 1 provided for a crankshaft (not shown) of a four-cycle internal combustion engine of four cylinders and the rotary body 1 rotates in association with a rotation of the crankshaft. Only ten convex portions 2 made of a magnetic material are continuously provided as portions to be detected on the outer periphery of the rotary body 1 at intervals of 30°. As shown by broken lines A, two convex portions are missing. An electromagnetic pickup 3 is arranged near the outer periphery of the rotary body 1. When the rotary body 1 rotates and the convex portion 2 passes near the electromagnetic pickup 3, a pulse of a negative polarity is generated from the electromagnetic pickup 3.

An ECU (Electric Control Unit) 4 is connected to an output of the electromagnetic pickup 3. The ECU 4 comprises a CPU 5, an RAM 6, an ROM 7, an input interface (I/F) circuit 8, output interface circuits 10 and 11, and an A/D converter 12. The input interface circuit 8 shapes the waveform of the pulse generated from the electromagnetic pickup 3 and transfers the resultant pulse as a pulse NE to the CPU 5. The CPU 5 executes an interrupting process in response to a trailing edge of the waveform shaped pulse NE supplied from the input interface circuit 8 and allows a count value of a counter (not shown) to be increased only by "1". The CPU 5 also executes an operation, which will be described hereinlater, and detects a crank angle. The CPU 5, RAM 6, ROM 7, input interface circuit 8, output interface circuits 10 and 11 and A/D converter 12 are commonly connected to a bus.

The output interface circuit 10 drives an injector 13 in response to an injector driving command from the CPU 5. The injector 13 is provided near an intake port of an intake pipe of the internal combustion engine and injects a fuel when it is driven. The output interface circuit 11 activates an ignition device 14 in response to a current supply start command and an ignition start command of each cylinder from the CPU 5. That is, the output interface circuit 11 starts a current supply to an ignition coil (not shown) for a corresponding cylinder in the ignition device 14 in response to the current supply start command, stops the current supply in response to the ignition start command, and allows a spark plug (not shown) for the corresponding cylinder to discharge a spark.

The A/D converter 12 is provided to convert analog signals from a plurality of sensors for detecting engine operation parameters such as intake pipe inner pressure $P_B$, cooling water temperature TW, throttle opening degree $\theta_{th}$, and oxygen concentration $O_2$ in an exhaust gas which are necessary for engine control into digital signals.

In the engine control system according to the invention having the above construction, the rotary body 1 rotates in association with the rotation of the crankshaft of the engine, so that the convex portion 2 passes near the electromagnetic pickup 3 and a pulse is generated from the electromagnetic pickup 3 at the time. The pulse is waveform shaped by the input interface circuit 8 and, after that, it is supplied to the CPU 5.

Figure 2:
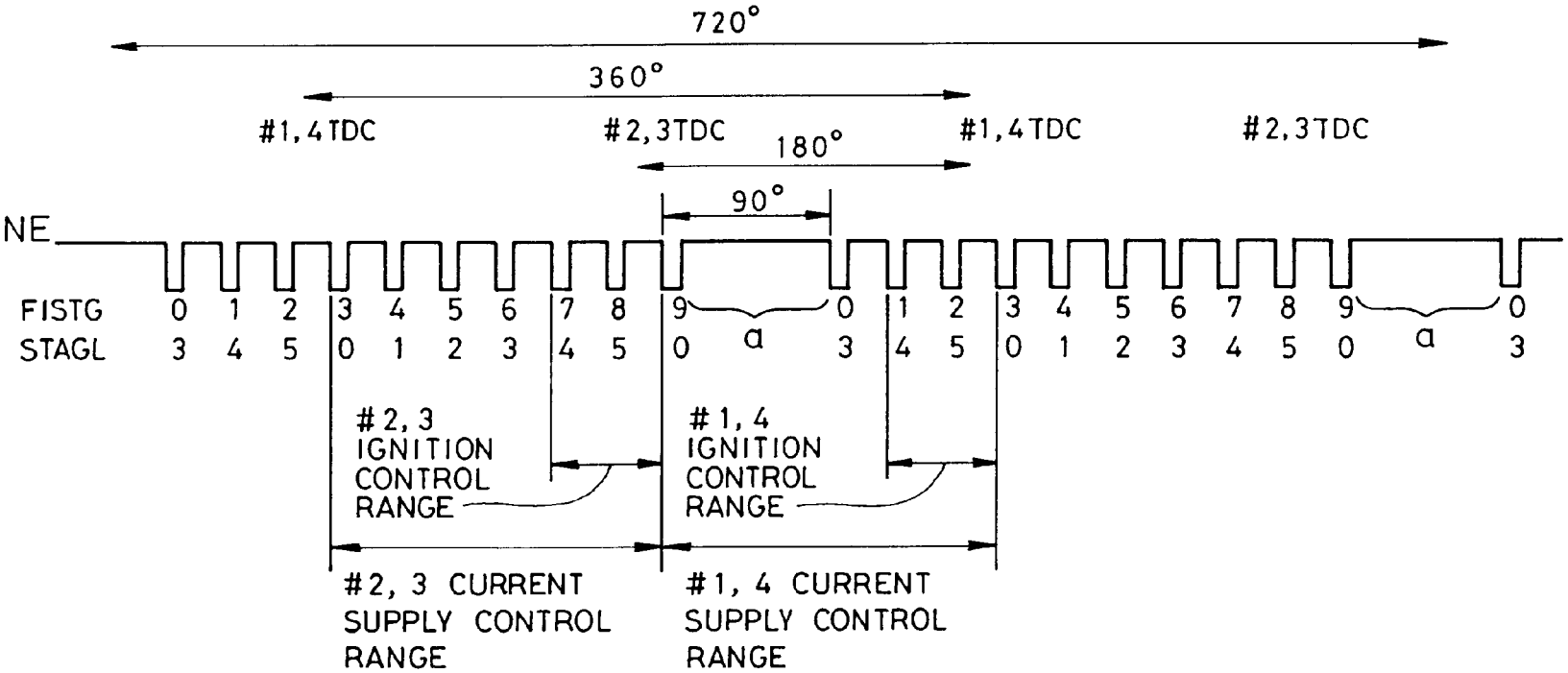
FIG. 2 is a diagram showing a pulse NE whose waveform is shaped.

FIG. 2 shows the waveform shaped pulse NE of the negative polarity. Since only two of the convex portions 2 formed on the rotary body 1 are missing, a cylinder discrimination is executed by using the pulse which comes after a no-pulse generating period of time (code a) corresponding to the missing portions as a reference. A first counter (not shown) in the CPU 5 is reset to "0" by the pulse NE which comes after the no-pulse generating period. A count value of the counter is shown by FISTG and is increased only by "1" each time the rotary body 1 rotates by 30°. By counting from 0 to 9, a period of 360° in which the rotary body 1 rotates once is shown. (FISTG=0) corresponds to the reference position time point of the crankshaft. The counter generates a period from a time point when the count value is changed until a time point when the count value is changed again, that is, a pulse interval ME from the generation of one pulse until the generation of the next pulse by counting the number of clock pulses. As shown in FIG. 2, the pulse interval ME is a period from the trailing edge of one pulse NE until the trailing edge of the next pulse NE. In FIG. 2, #1, 4 TDC denotes that pistons of the first and fourth cylinders are at the top dead center and #2, 3 TDC denotes that pistons of the second and third cylinders are at the top dead center.

Beside the counter to count the count value FISTG, the CPU 5 has a second counter (not shown) for counting a count value STAGL. As shown in FIG. 2, the count value STAGL is increased only by "1" each time the rotary body 1 rotates by 30°. A period of 180° in which the rotary body 1 rotates by ½ rotation is shown by counting from 0 to 5. As will be understood from FIG. 2, the count value STAGL is reset to 0 when FISTG=3 or 9 and is set to 3 when FISTG=0. That is, the count value STAGL eventually counts the pulses which correspond to the missing two convex portions and are not actually generated. By the count values FISTG and STAGL, a #2, 3 current supply control range for ignition coils for the second and third cylinders and a #2, 3 ignition control range for spark plugs, and a #1, 4 current supply control range for ignition coils for the first and fourth cylinders, and a #1, 4 ignition coil control range for spark plugs are determined.

Subsequently, a current supply start time setting operation and an ignition start time setting operation which are executed by the CPU 5 will be described. The current supply start time setting operation and the ignition start time setting operation are executed once each time the count value STAGL or FISTG is changed.

Figure 3:
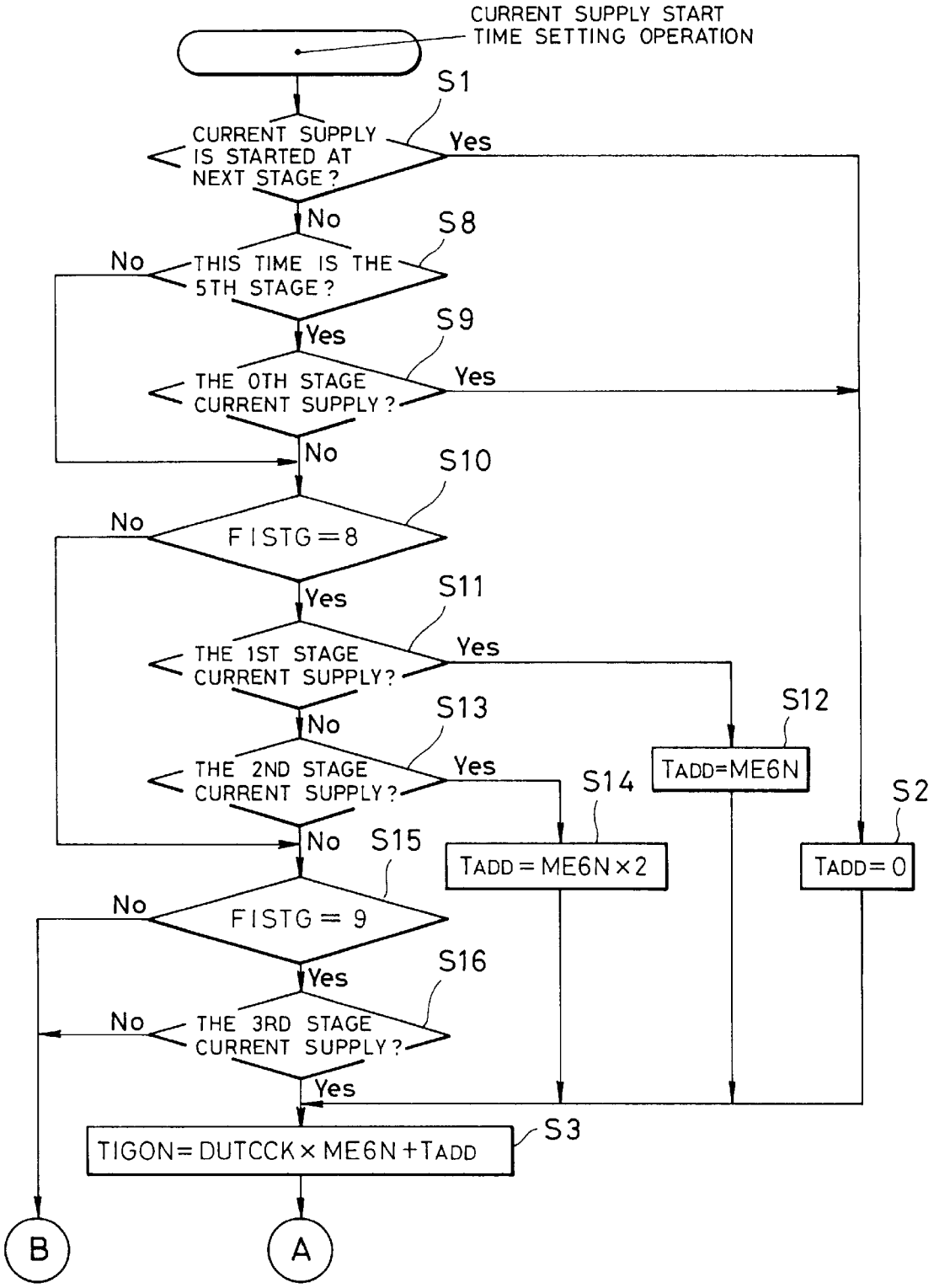
FIG. 3 is a flowchart showing the current supply start time setting operation.
Figure 4:
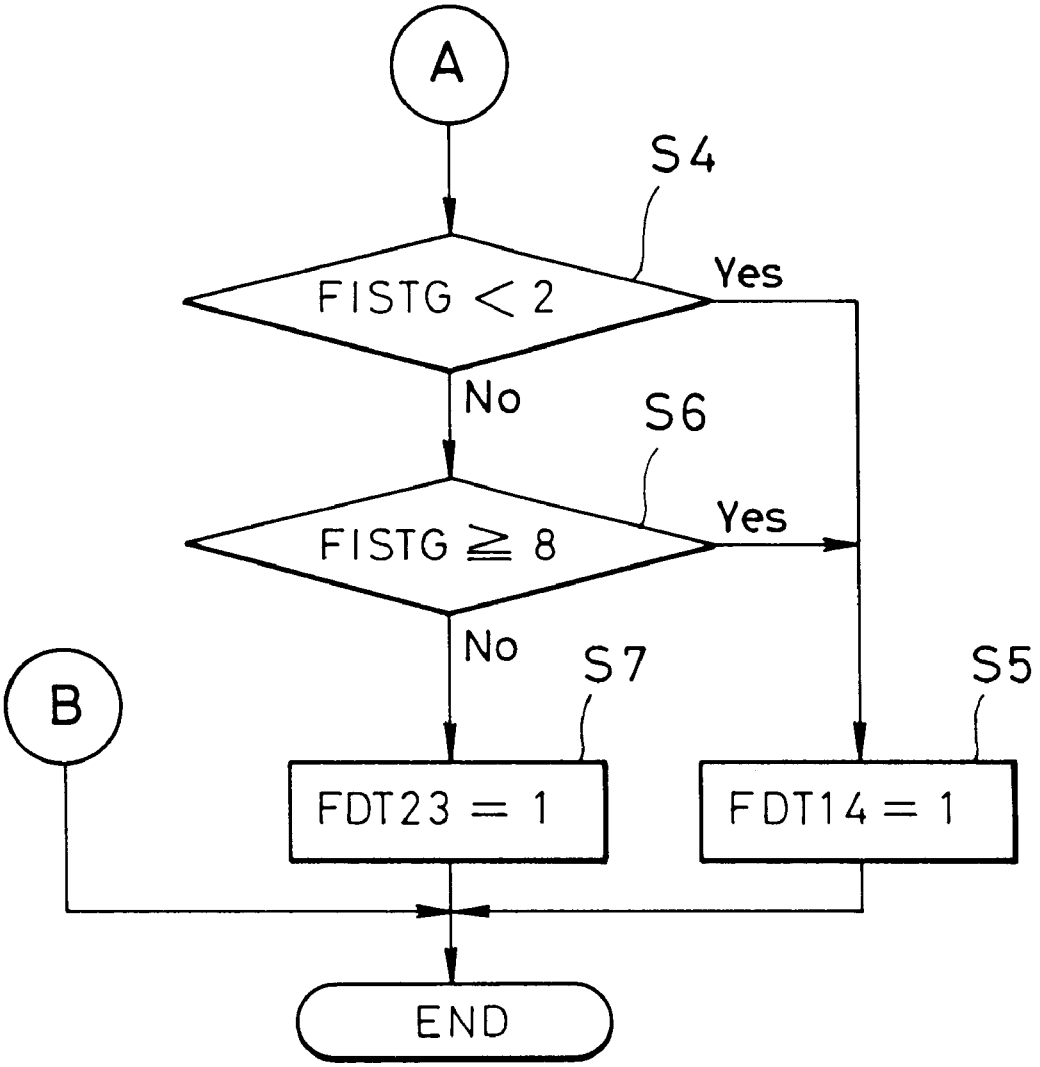
FIG. 4 is a flowchart showing a continuation portion of the current supply start time setting operation of FIG. 3.

When the current supply start time setting operation is started, as shown in FIGS. 3 and 4, the CPU 5 first discriminates whether the current supply is started or not within a period of the next stage from the generation of the pulse NE until the crankshaft rotates only by 30° (step S1). Stages are provided every 30°, the count value STAGL is acquired from the second counter and the count value STAGL indicates the stage number. For example, if the present second count value STAGL is equal to 3, the stage is the third stage (3STG) and whether the current supply is performed at the next fourth stage or not is discriminated in step S1. As mentioned above, since (STAGL≠1, 2) in a period where the count value STAGL is changed directly from 0 to 3, the count value STAGL is not always equal to its stage number in this period.

In step S1, when it is determined that the current supply is started in the next stage, an addition value $T_{ADD}$ is set to 0 (step S2). A current supply start time TIGON is calculated (step S3). The current supply start time TIGON is calculated by the following equation.

$$TIGON=DUTCCK\times ME6N+T_{ADD}$$

where, DUTCCK denotes a current supply start angle within 30° and ME6N indicates a pulse interval ME of the latest pulse NE. A period of time while no pulse NE is generated due to the missing of the convex portion 2 is derived, for instance, by presuming from a ratio of the pulse interval that is preceding by only 180°. In the above equation, by converting the angle to time, the current supply start time TIGON is calculated.

After execution of step S3, a check is made to see if the present first count value FISTG is smaller than 2 (step S4). When FISTG<2, since this means the current supply to the first and fourth cylinders, 1 is set into a flag FDT14 (step S5). If FISTG≧2, a check is further made to see whether the present first current value FISTG is equal to or larger than 8 or not (step S6). If FISTG≧8, step S5 follows and 1 is set into the flag FDT14. If FISTG<8, namely, when 2≦FISTG<8, since this means the current supply to the second and third cylinders, 1 is set into a flag FDT23 (step S7).

If the CPU 5 determines that the current supply is not performed within the next stage period in step S1, a check is made to see if the present count value STAGL is equal to 5 (step S8). If STAGL=5, a check is made to see if the next current supply is the zeroth stage (0STG) current supply (step S9). That is, when the present current value STAGL is equal to 5, since the count value STAGL is reset at the next stage and STAGL=0, whether the current supply is started within the 0th stage period or not is discriminated. In the case of the 0 stage current supply, steps S2 and S3 follows. The current supply start time TIGON is calculated as $T_{ADD}$=0 in step S3. When STAGL≠5 is decided in step S8 or when it is determined in step S9 that the 0th stage current supply is not performed, the CPU 5 discriminates whether the present first count value FISTG is equal to 8 or not (step S10). The result of (FISTG=8) denotes that after the next pulse NE was generated, a period of time when the pulse NE is not generated due to the missing of the convex portion 2 comes. When FISTG=8 is decided, therefore, a check is made to see if the next current supply is the first stage current supply (step S11). In the case of the first stage current supply, the addition value $T_{ADD}$ is equalized to the present pulse interval ME6N (step S12). If the next current supply is not the first stage current supply, a check is made to see if the next current supply is the second stage current supply (step S13). In the case of the second stage current supply, the addition value $T_{ADD}$ is equalized to the value in which the present pulse interval ME6N is doubled (step S14). After execution of step S12 or S14, step S3 follows and the current supply start time TIGON is calculated while including the addition amount due to the addition value $T_{ADD}$.

When it is determined that the next current supply is not the second stage current supply, a check is made to see if the present first count value FISTG is equal to 9 (step S15). When FISTG=9, a check is further made to see if the next current supply is the third stage current supply (step S16). In the case of the third stage current supply, step S2 follows and the addition value $T_{ADD}$ is set as 0.

Figure 5:
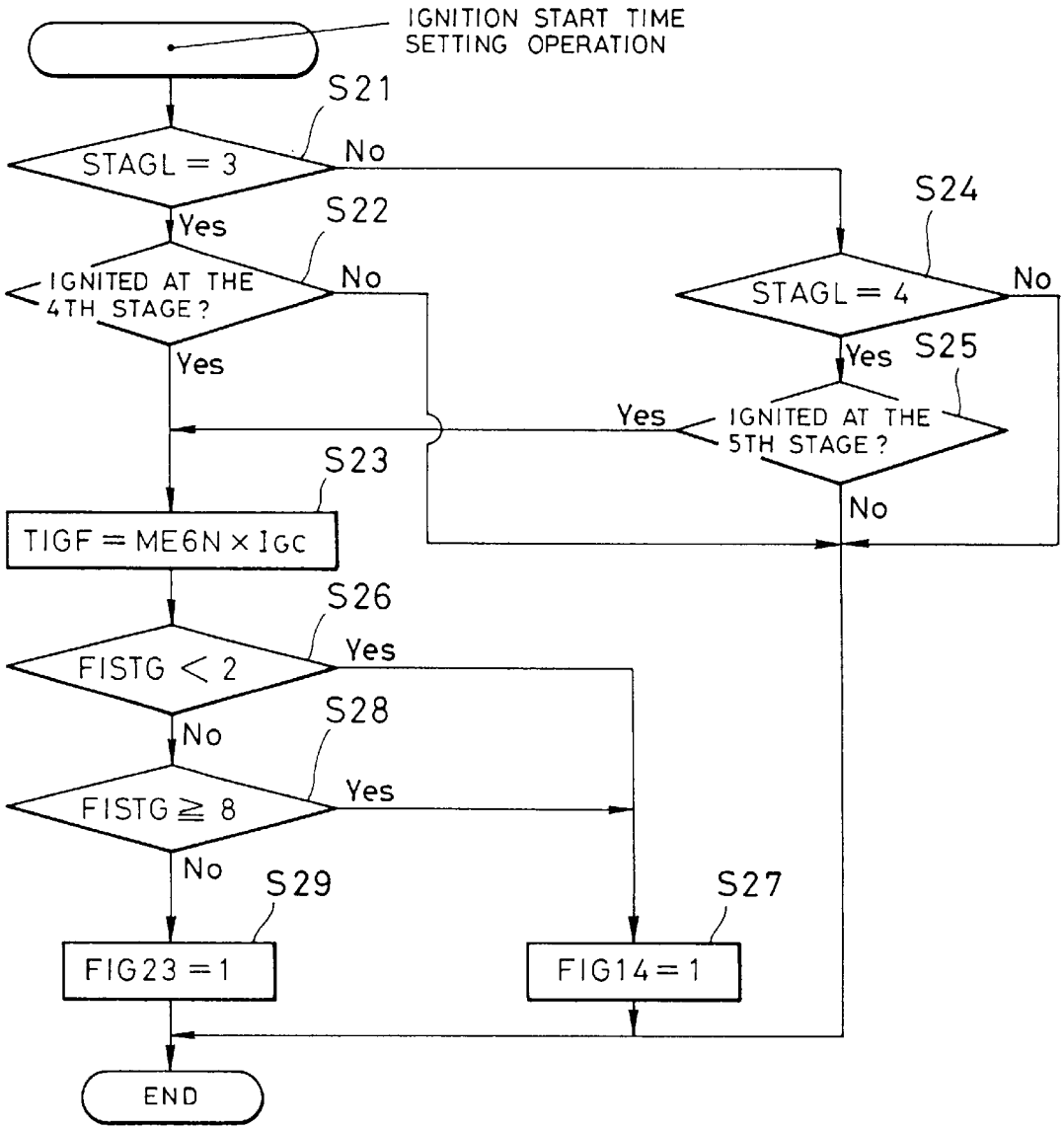
FIG. 5 is a flowchart showing the ignition start time setting operation.

In the ignition start time setting operation, as shown in FIG. 5, the CPU 5 reads the count value STAGL of the second counter and discriminates whether the count value STAGL is equal to 3 or not (step S21). When STAGL=3, a check is made to see if the ignition is performed at the next fourth stage (4STG) (step S22). If the ignition is performed at the next fourth stage, an ignition start time TIGF is calculated (step S23). To calculate the ignition start time TIGF, the present pulse interval ME6N is obtained and a coefficient $I_{GC}$ which has been predetermined in the pulse interval ME6N is multiplied.

When STAGL≠3 in step S21, the count value STAGL of the second counter is read and a check is made to see if the count value STAGL is equal to 4 (step S24). When STAGL=4, a check is made to see if the ignition is performed at the next fifth stage (5STG) (step S25). If the ignition is performed at the next fifth stage, step S23 follows and the ignition start time TIGF is calculated.

After execution of step S23, the CPU 5 discriminates whether the present first count value FISTG is smaller than 2 or not (step S26). If FISTG<2, since the ignition for the first and fourth cylinders is executed, 1 is set into a flag FIG14 (step S27). If FISTG≧2, a check is further made to see whether the present first count value FISTG is equal to or larger than 8 or not (step S28). If FISTG≧8, step S27 follows and 1 is set into the flag FIG14. If FISTG<8, namely, when 2≦FISTG<8, since this means the ignition for the second and third cylinders, 1 is set into the flag FIG23 (step S29).

Figure 6:
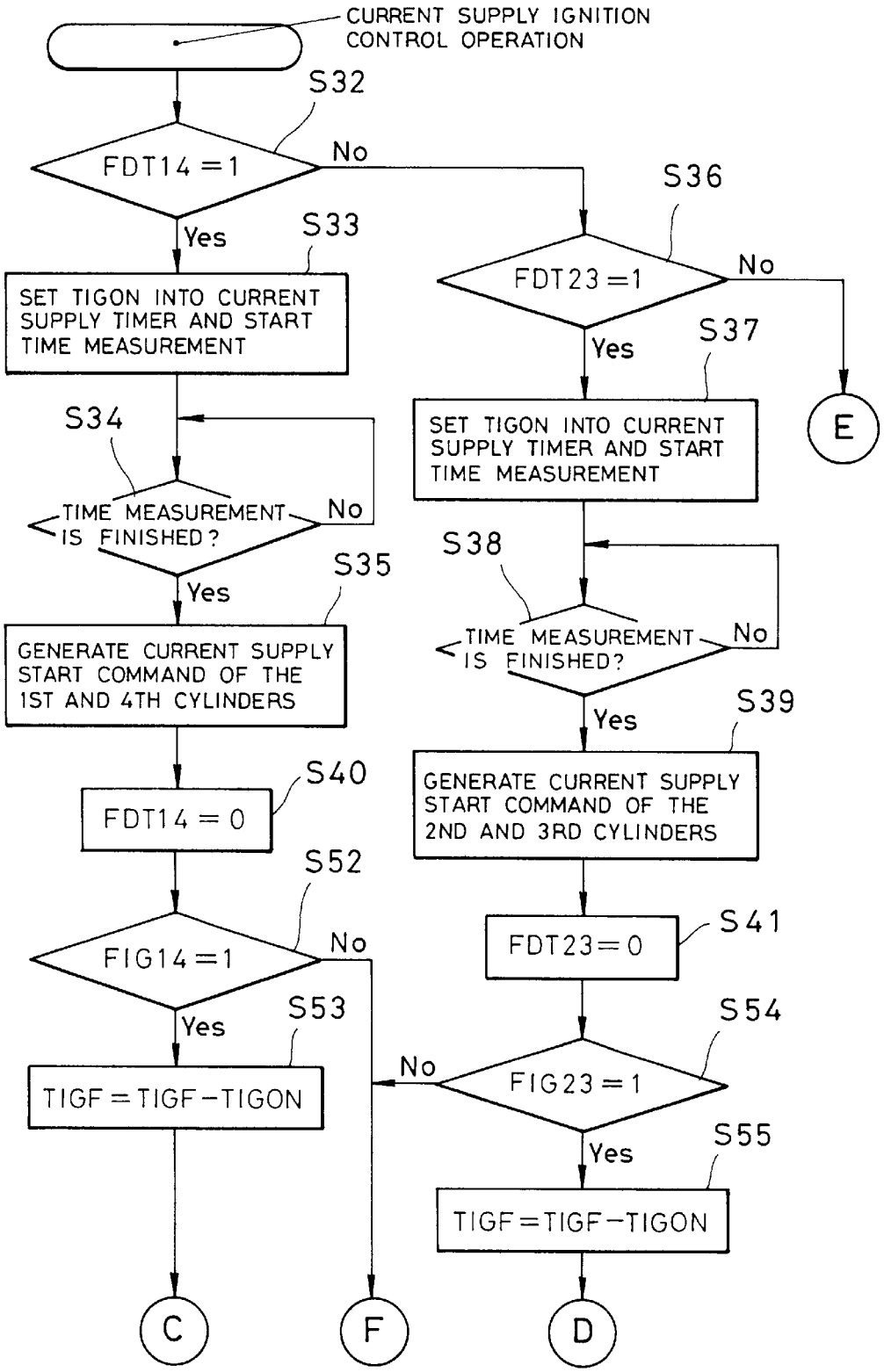
FIG. 6 is a flowchart showing the current supply ignition control operation.

As mentioned above, independent of the setting operations of the current supply start time TIGON and ignition start time TIGF, the CPU 5 executes the current supply ignition control operation as an interrupting process in response to the trailing edge of the pulse NE. In the current supply ignition control operation, as shown in FIG. 6, a check is made to see if the flag FDT14 is equal to 1 (step S32). If FDT14=1, the current supply start time TIGON is set into a current supply timer (not shown) which is formed in the CPU 5 by a program, thereby starting a time measurement (step S33). After execution of step S33, a check is made to see if the time measurement of the current supply start time TIGON by the current supply timer has been finished (step S34). When the time measurement of the current supply start time TIGON is finished, a current supply start command of the first and fourth cylinders is supplied to the ignition device 14 (step S35).

When FDT14=0, a check is made to see if the flag FDT23 is equal to 1 (step S36). If FDT23=1, the current supply start time TIGON is set to the current supply timer, thereby starting the time measurement (step S37). After execution of step S37, a check is made to see if the time measurement of the current supply start time TIGON by the current supply timer has been finished (step S38). When the time measurement of the current supply start time TIGON is finished, a current supply start command of the second and third cylinders is supplied to the ignition device 14 (step S39).

The CPU 5 resets the flag FDT14 to 0 (step S40) after completion of the execution of step S35. After execution of step S39, the CPU 5 resets the flag FDT23 to 0 (step S41).

Figure 7:
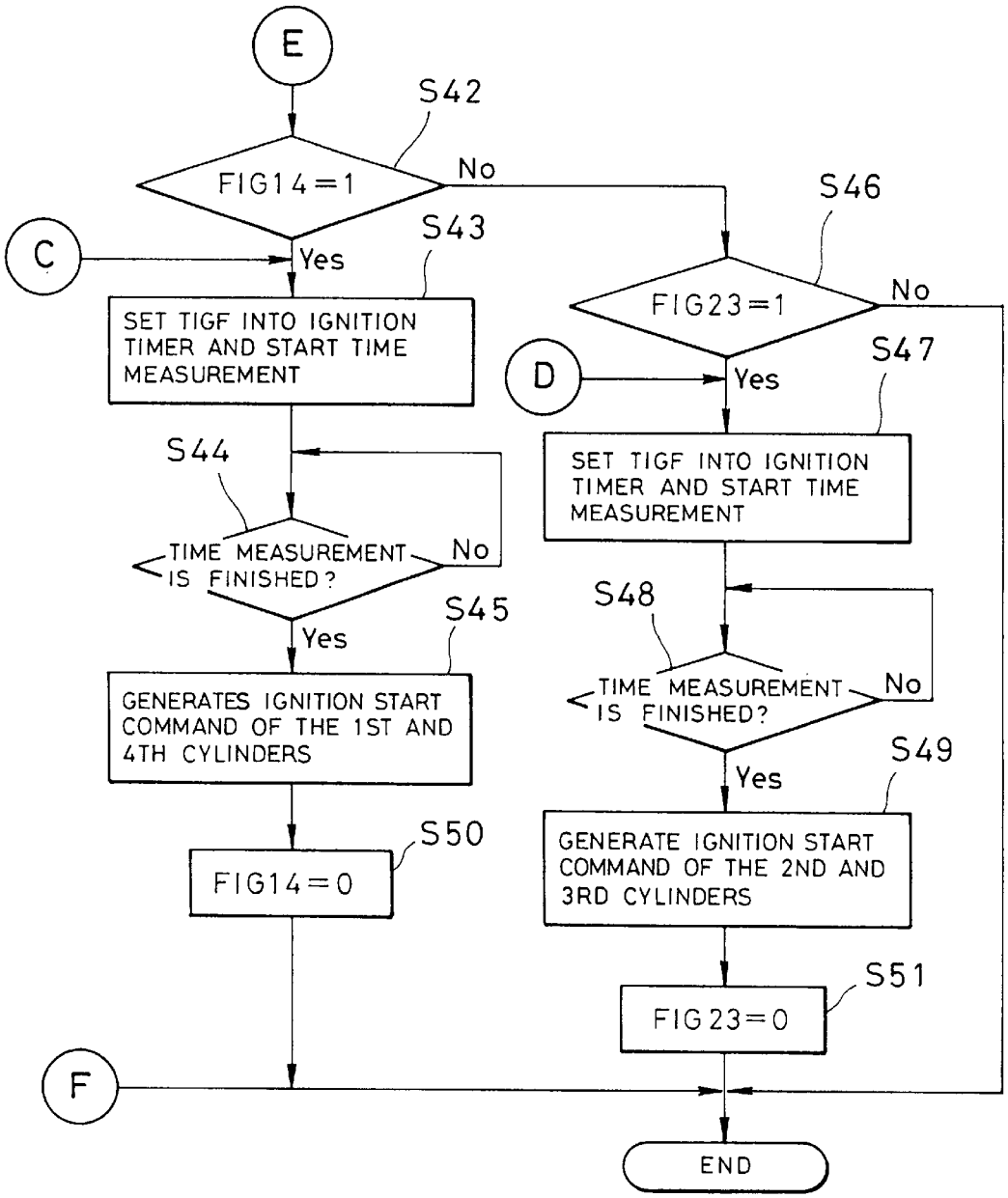
FIG. 7 is a flowchart showing a continuation portion of the current supply ignition control operation of FIG. 6.

On the other hand, if FDT23=0 in step S36, as shown in FIG. 7, a check is made to see if the flag FIG14 is equal to 1 (step S42). When FIG14=1, the ignition start time TIGF is set to an ignition timer (not shown) which is formed in the CPU 5 by a program, thereby starting the time measurement (step S43). After execution of step S43, a check is made to see if the time measurement of the ignition start time TIGF by the ignition timer has been finished (step S44). When the time measurement of the ignition start time TIGF is finished, the ignition start command of the first and fourth cylinders is supplied to the ignition device 14 (step S45).

Further, when FIG14=0 in step S42, a check is made to see if the flag FIG23 is equal to 1 (step S46). If FIG23=1, the ignition start time TIGF is set into the ignition timer, thereby starting the time measurement (step S47). After execution of step S47, a check is made to see if the time measurement of the ignition start time TIGF by the ignition timer has been finished (step S48). When the time measurement of the ignition start time TIGF is finished, the ignition start command of the second and third cylinders is supplied to the ignition device 14 (step S49).

The CPU 5 resets the flag FIG14 to 0 (step S50) after execution of step S45 and resets the flag FIG23 to 0 (step S51) after execution of step S49.

Since there is also a case where the current supply and the ignition are executed at the same stage, after execution of step S40, a check is made to see if the flag FIG14 is equal to 1 (step S52). If FIG14=1, the time obtained by subtracting the current supply start time TIGON from the ignition start time TIGF is set to the ignition start time TIGF (step S53). Step S43 follows. Similarly, after execution of step S41, a check is made to see if the flag FIG23 is equal to 1 (step S54). If FIG23=1, the time obtained by subtracting the current supply start time TIGON from the ignition start time TIGF is set to the ignition start time TIGF (step S55). Step S47 follows.

In the current supply ignition control operation shown in FIGS. 6 and 7, although the discrimination about the end of the time measurement in steps S34, S38, S44, and S48 is repeated until the detection of such an end, the other operation can be also performed until the end of the time measurement is detected. After the time measurement was started, it is also possible to shift to the other operation and to execute step S35, S39, S45, or S49 by an interrupting process in response to a timer output indicative of the end of the time measurement.

Figure 8:
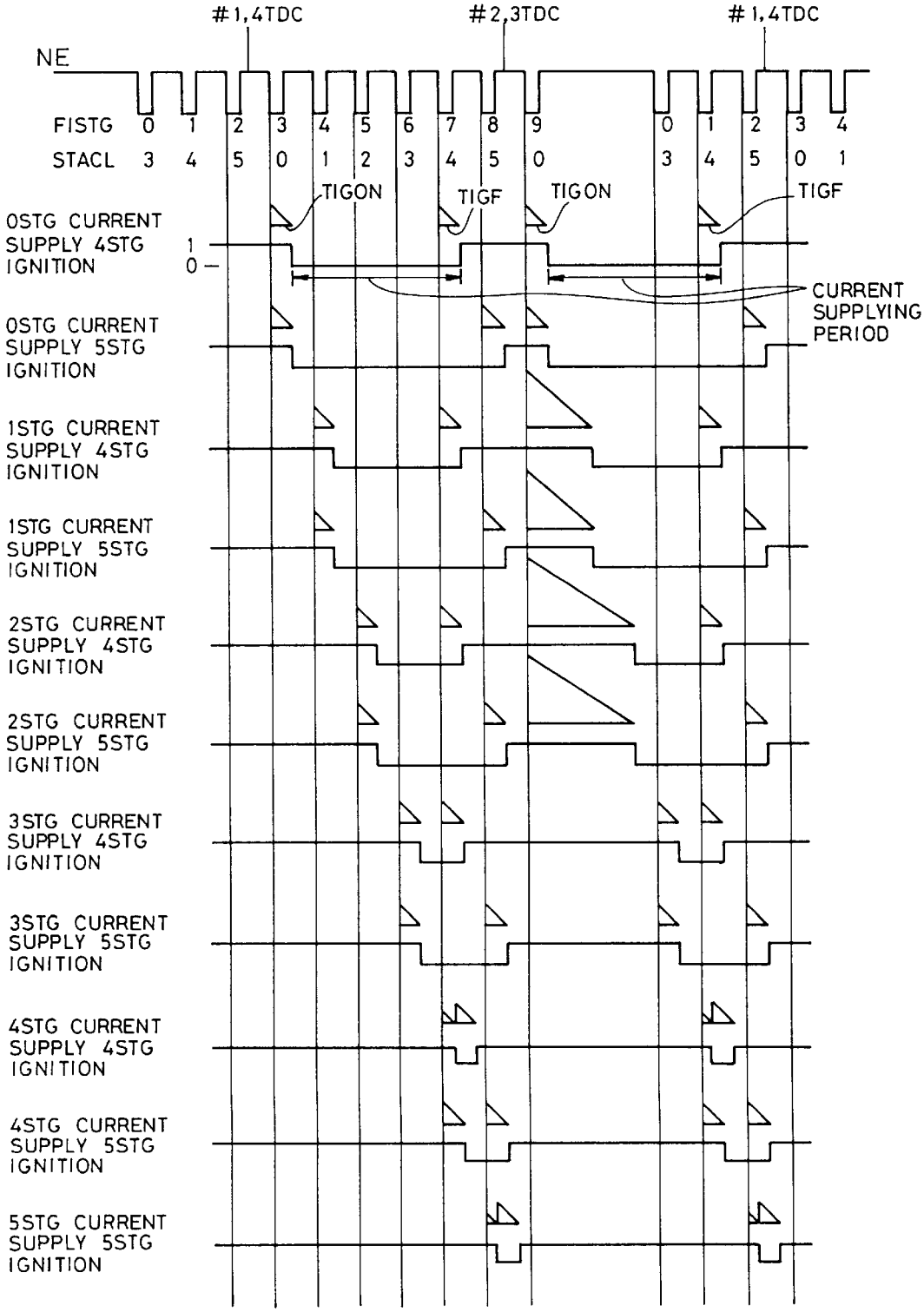
FIG. 8 is a diagram showing a timing for a current supply ignition.

FIG. 8 shows the ignition current supplying period of time and the ignition timing by the relations among the pulses NE, FISTG, and STAGL. A triangular shape shows either one of the current supply start time TIGON by the current supply timer and the ignition start time TIGF by the ignition timer. The current supply is started at the measurement end time point (the first or third triangular front edge point) of the current supply start time TIGON. The current supply is stopped at the measurement end time point (the second or fourth triangular front edge point) of the ignition start time TIGF and the ignition is performed. In FIG. 8, the current supplying period of time corresponds to, particularly, a portion of 0 as a pulse waveform of 0 or 1 as shown with respect to only the 4STG ignition for the 0STG current supply and the time point of the end of the current supplying period corresponds to the ignition time point.

In FIG. 8, for the 0STG current supply to start the current supply at the 0th stage, there are the 4STG ignition to perform the ignition at the fourth stage and the 5STG ignition to perform the ignition at the fifth stage. In the case of the 4STG ignition, the time measurement of TIGON is started at the same time as the start of the 0th stage of STAGL=0. When the time measurement of TIGON is finished, the current supply to the ignition coils of the second and third cylinders or the first and fourth cylinders is started. After that, in the case of the 4STG ignition, the time measurement of TIGF is started at the same time as the start of the fourth stage of STAGL=4. When the time measurement of TIGF is finished, the current supply is stopped, thereby starting a spark discharge of the ignition plugs for the second and third cylinders or the first and fourth cylinders. In the case of the 5STG ignition, the time measurement of TIGF is started simultaneously with the start of the fifth stage of STAGL=5. When the time measurement of TIGF is finished, the current supply is stopped, so that a high voltage is caused and the spark discharge of the ignition plugs for the second and third cylinders or the first and fourth cylinders is started.

For the 1STG current supply to start the current supply at the first stage, there are also the 4STG ignition and 5STG ignition. In the case of the 4STG ignition for the second and third cylinders, the time measurement of TIGON is started at the same time as the start of the first stage of STAGL=1 when FISTG=4 in a manner similar to the 4STG ignition for the 0STG current supply. In the case of the 4STG ignition for the first and fourth cylinders, however, the time measurement of TIGON is started simultaneously with the start of the 0th stage of STAGL=0 when FISTG=9. The time measurement of TIGON is finished for the period of time of the first stage and the current supply to the ignition coils for the first and fourth cylinders is immediately started. After that, the time measurement of TIGF is started simultaneously with the start of the fourth stage of STAGL=4. When the time measurement of TIGF is finished, the current supply is stopped, so that a high voltage is caused and the spark discharge of the ignition plugs for the first and fourth cylinders is started. The operation in the case of the 5STG ignition for the 1STG current supply is also similar to that in the 4STG ignition for the 1STG current supply.

There are the 4STG ignition and 5STG ignition even for the 2STG current supply to start the current supply at the second stage. In the case of the 4STG ignition for the second and third cylinders, the time measurement of TIGON is started at the same time as the start of the second stage of STAGL=2 when FISTG=5 in a manner similar to the 4STG ignition for the 0STG current supply. However, in the case of the 4STG ignition for the first and fourth cylinders, the time measurement of TIGON is started at the same time as the start of the 0th stage of STAGL=0 when FISTG=9. The time measurement of TIGON is finished for the period of time of the second stage and the current supply to the ignition coils for the first and fourth cylinders is immediately started. After that, the time measurement of TIGF is started simultaneously with the start of the fourth stage of STAGL=4. When the time measurement of TIGF is finished, the current supply is stopped, so that a high voltage is caused, thereby starting the spark discharge of the ignition plugs for the first and fourth cylinders. The operation in the case of the 5STG ignition for the 2STG current supply is also similar to that in the 4STG ignition for the 2STG current supply.

There are also the 4STG ignition and 5STG ignition for the 3STG current supply to start the current supply at the third stage. Since they are similar to the 4STG ignition and 5STG ignition for the 0STG current supply, their descriptions are omitted here.

There are also the 4STG ignition and 5STG ignition for the 4STG current supply to start the current supply at the fourth stage. In the 4STG ignition for the 4STG current supply, the time measurement of TIGON is started simultaneously with the start of the fourth stage of STAGL=4. The time measurement of TIGON is finished for the period of time of the fourth stage and the current supply to the ignition coils for the first and fourth cylinders is started. The time measurement of TIGF is started at the same time as the end of the time measurement of TIGON. When the time measurement of TIGF is finished in the period of time of the fourth stage, the current supply is stopped, so that a high voltage is caused, thereby starting the spark discharge of the ignition plugs for the second and third cylinders. The TIGF which is time measured is equal to the residual amount obtained by subtracting TIGON from the calculated TIGF. The operation of the 5STG ignition for the 4STG current supply is also similar to that in the 4STG ignition for the 0STG current supply or the like.

There is only the 5STG ignition for the 5STG current supply to start the current supply to the fifth stage and it is similar to the 4STG ignition for the 4STG current supply.

Figure 9:
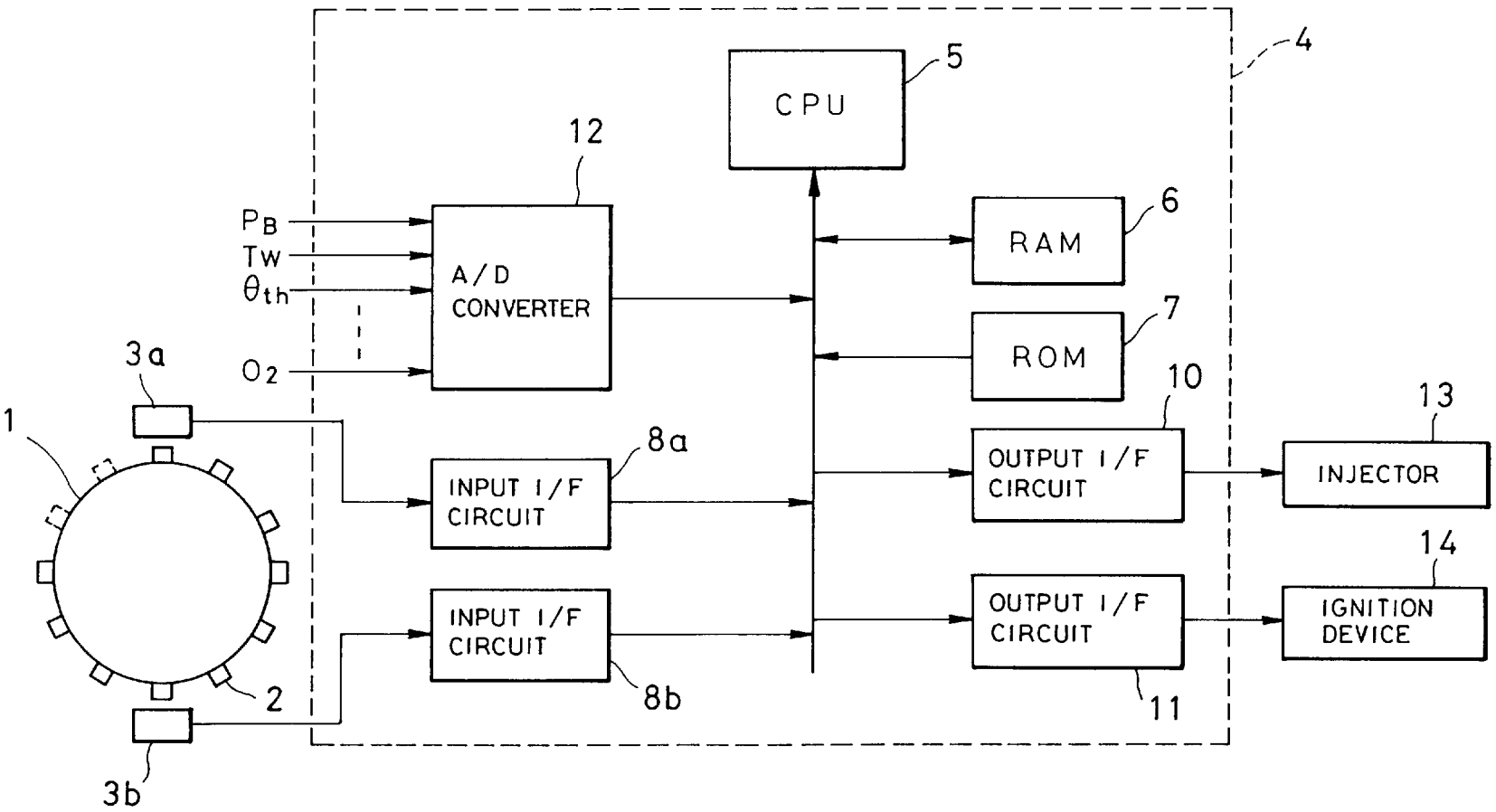
FIG. 9 is a block diagram showing an embodiment of the invention.

FIG. 9 further shows an embodiment of the invention. In the engine control system, two electromagnetic pickups 3*a* and 3*b* are arranged near the outer periphery of the rotary body 1. The arranging positions of the electromagnetic pickups 3*a* and 3*b* have a crank angle difference of 180°. The arranging position of the electromagnetic pickup 3*a* is the same as that of the electromagnetic pickup 3 in FIG. 1. Each of the electromagnetic pickups 3*a* and 3*b* generates a pulse when the convex portion 2 passes a region near the pickup in association with the rotation of the rotary body 1.

The ECU 4 is connected to outputs of the electromagnetic pickups 3*a* and 3*b*. In a manner similar to FIG. 1, the ECU 4 has input interface circuits 8*a* and 8*b* so as to correspond to the electromagnetic pickups 3*a* and 3*b* in addition to the CPU 5, RAM 6, ROM 7, output interface circuits 10 and 11, and A/D converter 12. The input interface circuit 8*a* waveform shapes the pulse generated from the electromagnetic pickup 3*a* and transmits the resultant pulse as a first pulse NE1 to the CPU 5. The input interface circuit 8*b* waveform shapes the pulse generated from the electromagnetic pickup 3*b* and transmits the resultant pulse as a second pulse NE2 to the CPU 5. A counter for individually counting the waveform shaped pulses generated from the input interface circuits 8*a* and 8*b* is formed in the CPU 5 by a program process. The other construction is similar to that of the system of FIG. 1.

Figure 10:
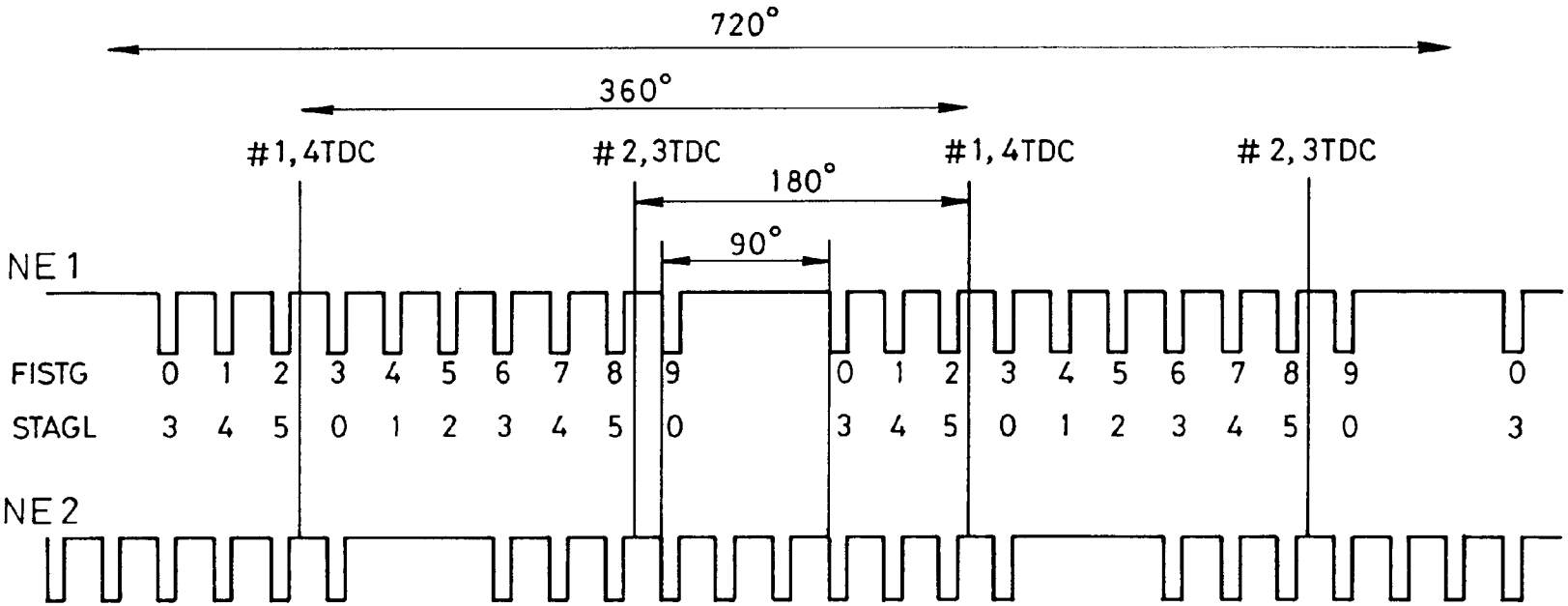
FIG. 10 is a diagram showing pulses NE1 and NE2 in each of which a waveform has been shaped.

In the engine control system of the above construction, the rotary body 1 rotates in association with the rotation of a crankshaft of the engine, so that each convex portion 2 passes near the electromagnetic pickups 3*a* and 3*b*. In this instance, a pulse is generated from each of the electromagnetic pickups 3*a* and 3*b*. As shown in FIG. 10, the first and second pulses NE1 and NE2 which are generated from the electromagnetic pickups 3*a* and 3*b* have a phase difference of 180° and are waveform shaped by the input interface circuits 8*a* and 8*b*. After that, the resultant pulses are supplied to the CPU 5.

Figure 11:
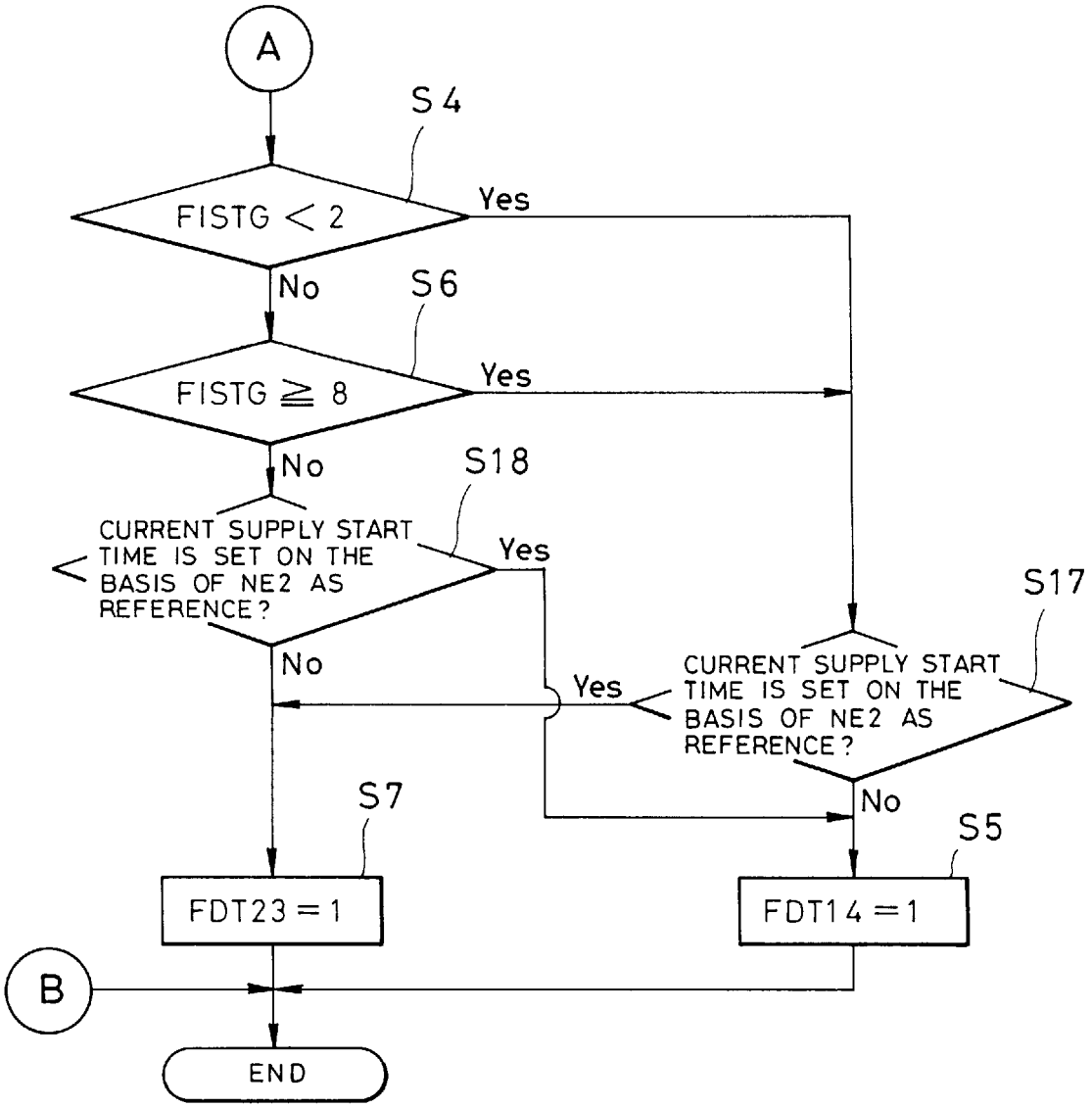
FIG. 11 is a flowchart showing a part of the current supply start time setting operation.

In the current supply start time setting operation by the CPU 5, as shown in FIG. 11, if it is determined that FISTG<2 in step S4 or FISTG≦8 in step S6, the CPU 5 discriminates whether the operation so far is the current supply start time setting operation while the second pulse NE2 is used as a reference or not (step S17). If it is determined in steps S4 and S6 that 2≦FISTG<8, a check is made to see if the operation so far is the current supply start time setting operation while using the second pulse NE2 as a reference or not (step S18). That is, although the current supply start time setting operation using the first pulse NE1 as a reference is usually executed, when the first pulse NE1 is not supplied to the CPU 5 due to a failure or the like of the electromagnetic pickup 3*a*, the CPU 5 executes the current supply start time setting operation using the second pulse NE2 as a reference. The operation of FIG. 11 is a portion subsequent to the current supply start time setting operation shown in FIG. 3 mentioned above and there is no change in the operation shown in FIG. 3.

When the CPU 5, accordingly, determines that the operation so far is the current supply start time setting operation using the first pulse NE1 as a reference in step S17, in order to show the current supply to the first and fourth cylinders, step S5 follows and 1 is set into the flag FDT14. If the current supply start time setting operation using the second pulse NE2 as a reference is determined in step S17, to show the current supply to the second and third cylinders, the processing routine advances to step S7 and 1 is set into the flag FDT23. Similarly, when the current supply start time setting operation using the first pulse NE1 as a reference is decided in step S18, to show the current supply to the second and third cylinders, step S7 follows and 1 is set into the flag FDT23. When the current supply start time setting operation using the second pulse NE2 as a reference is decided in step S18, to show the current supply to the first and fourth cylinders, step S5 follows and 1 is set into the flag FDT14.

Figure 12:
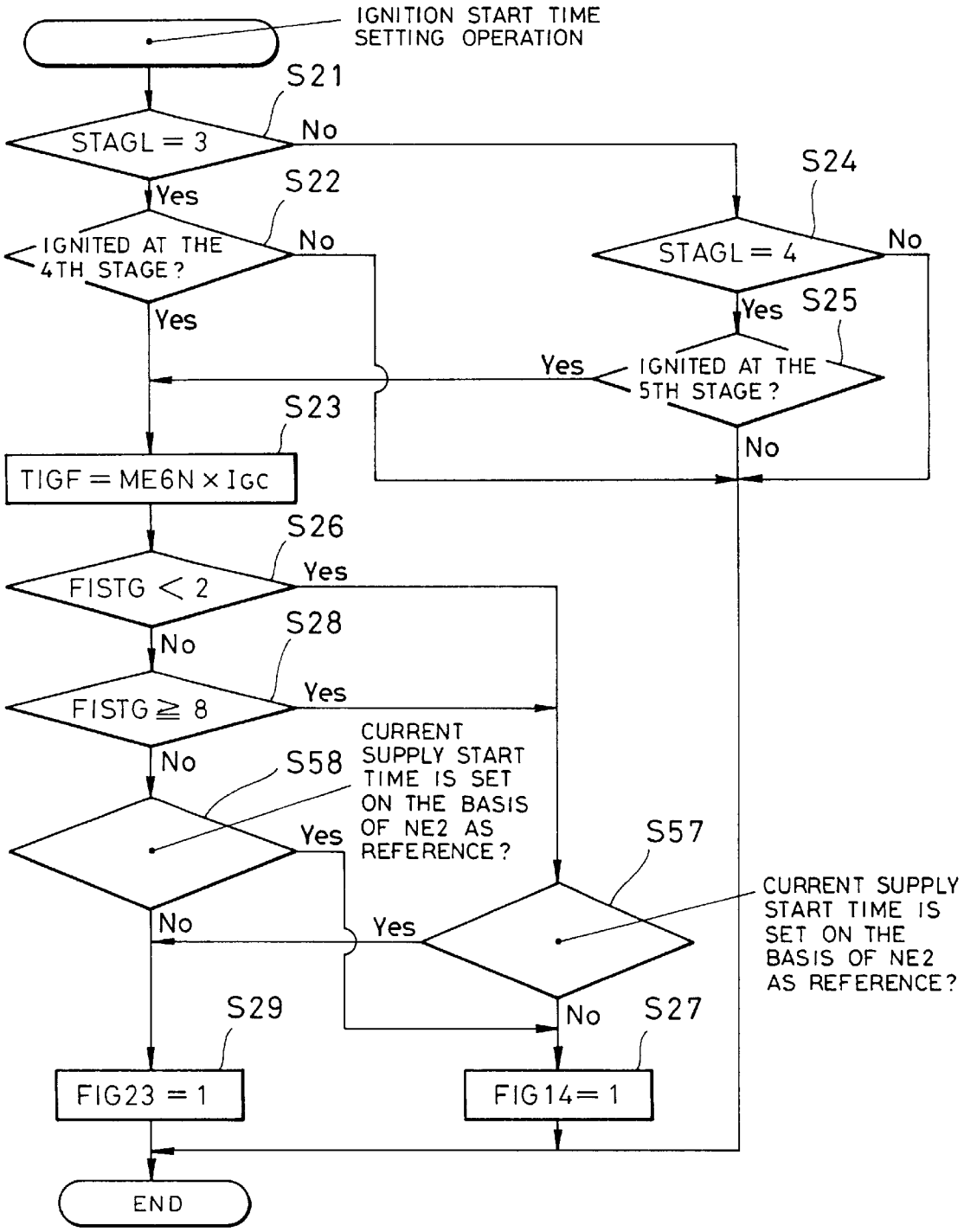
FIG. 12 is a flowchart showing the ignition start time setting operation.

In the ignition start time setting operation by the CPU 5, in a manner similar to the current supply start time setting operation, as shown in FIG. 12, when it is determined that FISTG<2 in step S26 or FISTG≧8 in step S28, the CPU 5 discriminates whether the operation so far is the current supply start time setting operation using the second pulse NE2 as a reference or not (step S57). When it is determined that 2≦FISTG<8 in steps S26 and S28, a check is made to see if the operation so far is the current supply start time setting operation using the second pulse NE2 as a reference or not (step S58). That is, although the ignition start time setting operation using the first pulse NE1 as a reference is generally executed, when the first pulse NE1 is not supplied to the CPU 5 due to a failure or the like of the electromagnetic pickup 3*a*, the CPU 5 executes the ignition start time setting operation using the second pulse NE2 as a reference.

When the CPU 5, therefore, decides the ignition start time setting operation using the first pulse NE1 as a reference in step S57, to show the ignition for the first and fourth cylinders, step S27 follows and 1 is set into the flag FIG14. In step S57, when the ignition start time setting operation using the second pulse NE2 as a reference is determined, to show the ignition for the second and third cylinders, step S29 follows and 1 is set into the flag FIG23. Similarly, when the ignition start time setting operation using the first pulse NE1 as a reference is decided, to show the ignition for the second and third cylinders, step S29 follows and 1 is set into the flag FIG23. In step S58, when the ignition start time setting operation using the second pulse NE2 as a reference is determined, to show the ignition for the first and fourth cylinders, step S27 follows and 1 is set into the flag FIG14.

In the above embodiment, although each of the pickups 3, 3*a*, and 3*b* magnetically detects the convex portion, it can be also optically detected by a pickup. Further, a portion to be detected is not limited to the convex portion but a magnetic material embedded in the rotary body can be used or a mark which can be optically detected is formed on the outer periphery of the rotary body and can be also detected by a photosensor. The portion to be detected can be also provided near the outer periphery of the side surface of the rotary body instead of the outer periphery of the rotary body.

In the foregoing embodiment, although two continuous portions to be detected among a plurality of portions to be detected of the rotary body have been missing, one portion to be detected can be missing or three or more portions to be detected can be also missing.

Further, although the foregoing embodiment relates to the example of applying the invention to the 4-cycle engine of four cylinders, the invention can be also applied to a multi-cylinder engine such as a 4-cycle engine of 6 cylinders or the like.

Although the current supply control to the ignition coils has been described as a predetermined control of the engine in the above embodiment, the invention can be also similarly applied to an ignition control or a fuel injection control.

In the above embodiment, further, the time point to stop the current supply and ignite has been set to the fourth or fifth stage. This is because since higher precision is requested to the ignition time point than the current supply time point, a situation that the measurement time of the time until the start of the ignition becomes long due to an influence by the missing of the convex portion is prevented.

According to the invention as mentioned above, when the reference time point to start the measurement of the time until the control start time point to start a predetermined control of the engine is equal to the rotational angle time point of the crankshaft when no pulse is generated from the first pickup due to the missing portion to be detected, the timer is allowed to measure the time from the time point of the pulse generated from the first pickup just before the non-pulse generating period of time during which no pulse is formed to the control start time point.

By using the engine control system of the invention, therefore, even when the angle position of the crankshaft is located at an angle position of every predetermined angle from the reference position time point, even if there is a period of time during which no pulse is generated from the pickup due to the missing of the portion to be detected such as a convex portion of the rotary body, even when a predetermined control of the engine which should be set to the start time point of the time measurement exists at the angle position time point of the crankshaft within such a period of time, the time until the engine control start time point can be accurately measured. There is, consequently, no need to early set the engine control start time point and the proper engine control can be performed. The engine control timings such as fuel injection timing, current supply timing, and ignition timing can be accurately obtained.

What is claimed is:

1. An engine control system comprising:

a rotary body which rotates in association with a crankshaft of an engine and has portions to be detected spaced at predetermined angles wherein detection of said portions generates corresponding rotational angle time points and wherein at least one of said portions to be detected is missing;

a first pickup, arranged near an outer periphery of said rotary body, for generating a pulse each time said portion to be detected passes;

setting means for setting a time period prior to a control start time point to start a predetermined control of said engine, based upon one of said rotational angle time points; and timer control means for allowing a timer to measure the time period prior to the control start time point while using a generation time point of the pulse that is generated from said first pickup as a reference, wherein when the time period prior to the control start time point using the rotational angle time point of said crankshaft when no pulse is generated from said first pickup due to the missing portion to be detected, is used as a references is set by said setting means, said timer control means allows said timer to measure the time from the generation time point of the pulse generated from said first pickup just before the non-pulse generation period of time during which no pulse is generated until the control start time point.

2. An system according to claim 1, wherein said setting means sets a time until a current supply start time point to start a current supply to an ignition coil as the time until said control start time point.

3. An system according to claim 2, wherein said setting means sets a time until an ignition start time point to finish the current supply to the ignition coil and allow an ignition plug to start a spark discharge, and the ignition start time point is set to a time out of said non-pulse generation period of time.

4. An system according to claim 2, further comprising a second pickup which is arranged near the outer periphery of said rotary body so as to have an angle difference of 180° from said first pickup and generates a pulse each time said portion to be detected passes, and wherein when said first pickup is out of order, said timer control means allows a current supply timer to measure the time until the current supply start time point by using a generation time point of the pulse which is generated as a reference from said second pickup.

* * * * *